US005092045A

United States Patent [19]

Boyd, Jr. et al.

[11] Patent Number: 5,092,045

[45] Date of Patent: Mar. 3, 1992

[54] LOCK BLOCK FOR A MULTIPLED-POSITIONED KNIFE OR DEVICE

[76] Inventors: Francis M. Boyd, Jr., 1015 Girard St., San Francisco, Calif. 94134; Frank M. Boyd, Sr., 21144 Kingcrest Dr., Saugus, Calif. 91350

[21] Appl. No.: 480,875

[22] Filed: Feb. 16, 1990

[51] Int. Cl.[5] ..... B26B 1/04

[52] U.S. Cl. ..... 30/161; 30/331

[58] Field of Search ..... 30/160, 161, 330, 331, 30/135

[56] References Cited

U.S. PATENT DOCUMENTS 4,439,922 4/1984 Sassano ..... 30/161

4,541,175 9/1985 Boyd et al. ..... 30/161

*Primary Examiner*—Douglas D. Watts

*Attorney, Agent, or Firm*—Frank L. Zugelter

[57] ABSTRACT

A locking mechanism (39) comprising a rectangularly-shaped block (40) seated in a corresponding opening (41) of a blade (31) and a corresponding opening of a handle scale (32). Block (40) depresses into opening (41) after which blade (31) is free to rotate between locked open and closed modes, effecting two-position lock mechanism. Other embodiments include a stepped blocks (61, 81) by which two or one notches are utilized to effect either a two-position or one-position lock mechanism, respectively. These blocks register in their respective openings (42, 73, 89) provided in handle scale. The register in the opening (89) in the scale for the one-position lock mechanism is off-set in a direction towards the center of rotation for the blade (31).

14 Claims, 5 Drawing Sheets

30
31
32
33
34
35
36
37
39
40
41
42
44
45
48
49
50
52
54
5

54
32
73
52
68
65
61
60
67
63
67
64
62
45
64
41
31
34
37
44
33

FIG. 12.
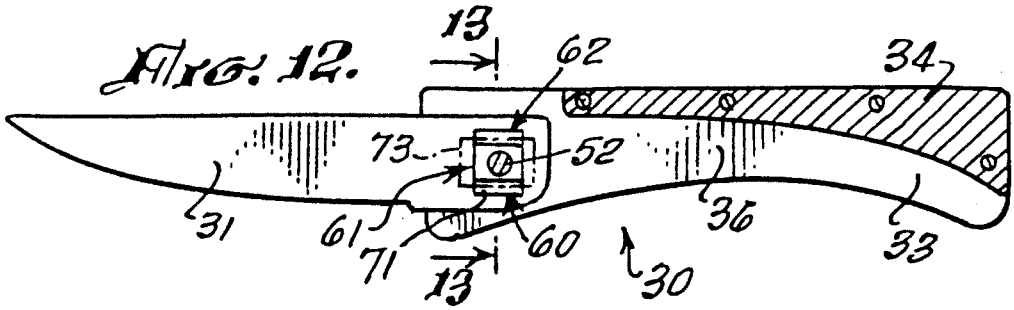
FIG. 13.
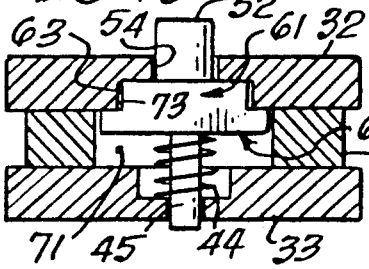
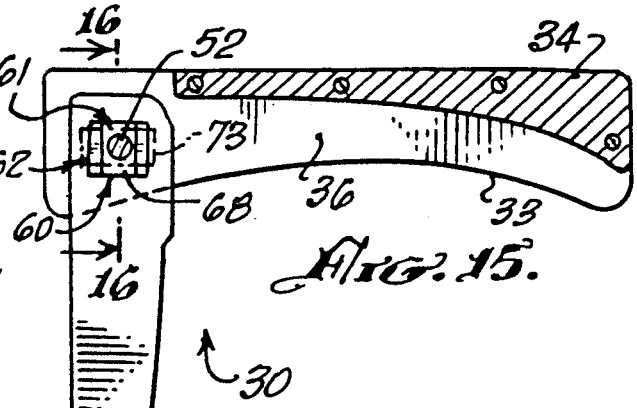
FIG. 15.
FIG. 14
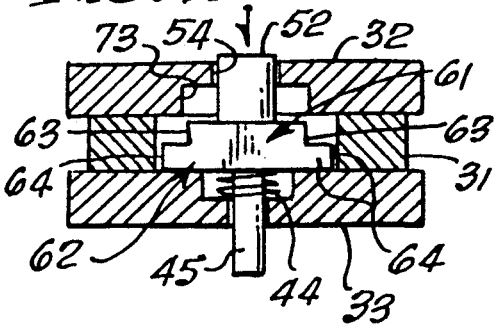
FIG. 16.
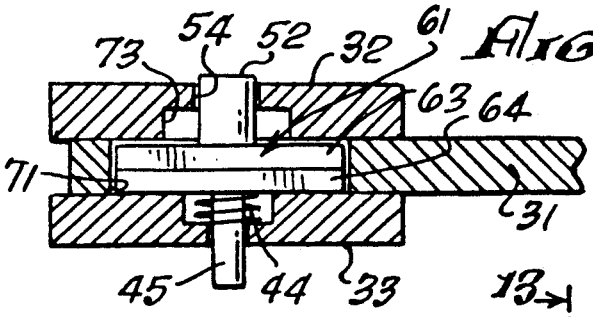
FIG. 17.
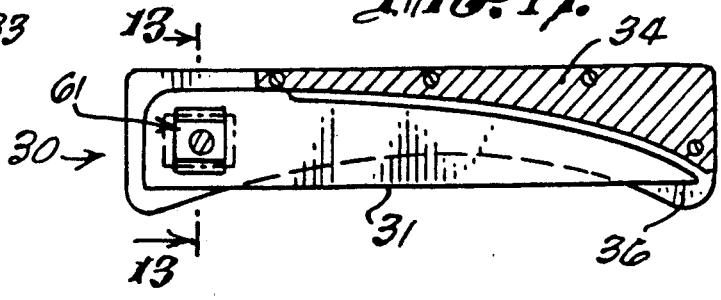

FIG. 19.
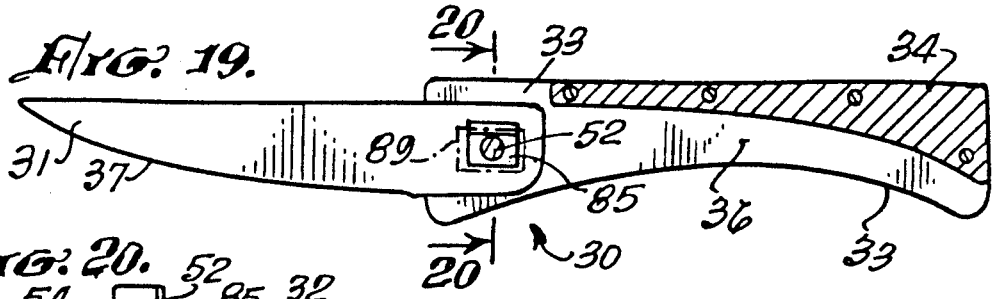
FIG. 20.
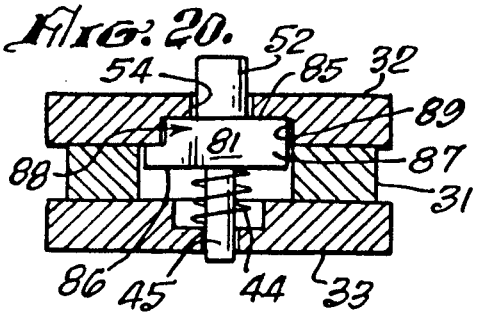
FIG. 21.
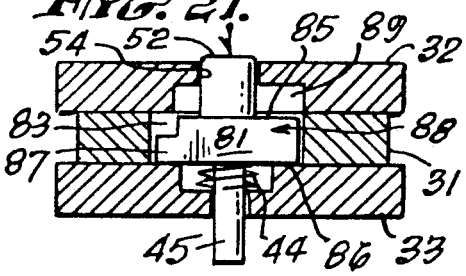
FIG. 22.
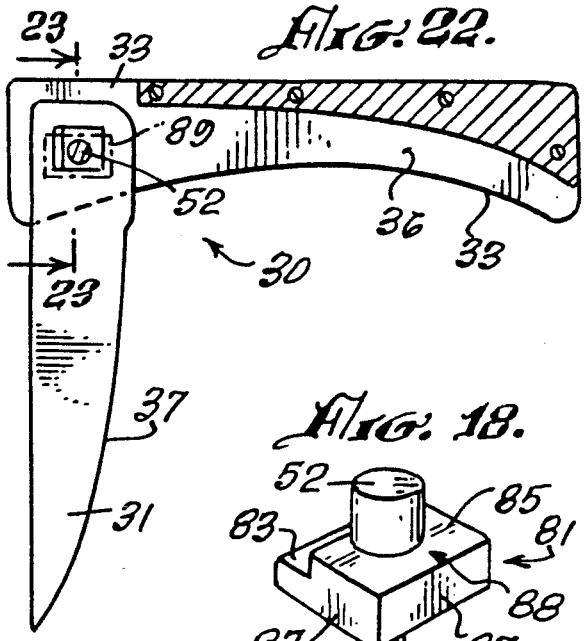
FIG. 18.
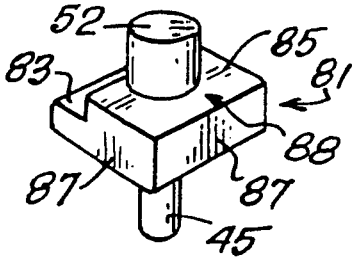
FIG. 23.
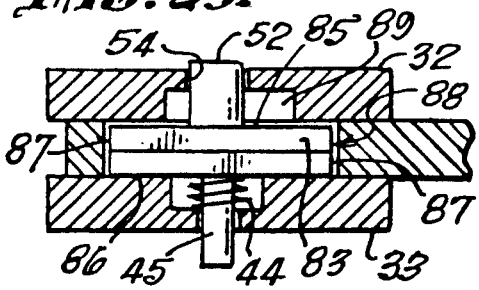
FIG. 25.
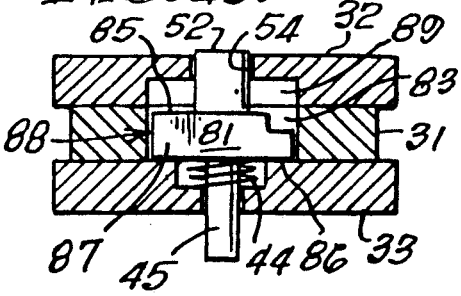
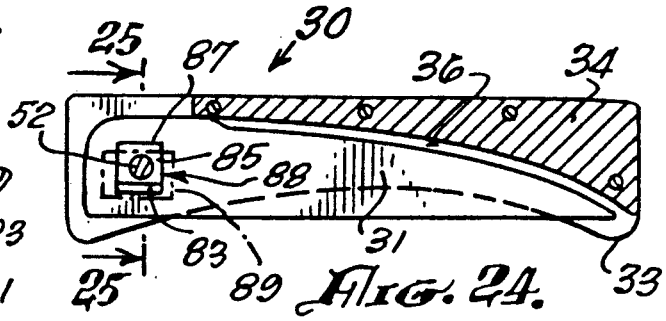
FIG. 24.

LOCK BLOCK FOR A MULTIPLED-POSITIONED KNIFE OR DEVICE

TECHNICAL FIELD

This invention relates to a knife, and more particularly to a foldable knife having dual capacities, by being locked in either a one-position mode or a two-position mode.

BACKGROUND ART

Prior art regarded as useful for the understanding, searching and examining of this invention will be found in U.S. Pat. Nos. 3,942,249; 4,170,061; 4,541,175; 4,670,984; 4,750,267; and the teachings of record in each of such noted U.S. Letters Patent.

DISCLOSURE OF THE INVENTION

The invention comprises a locking mechanism for a foldable knife in which particular elements are put into opposition with one another to constitute a locked or fixed condition. As an example, a block is rectangularly configured or otherwise non-arcuately polyhedrally configured for disposition in a correspondingly shaped opening in one of the knife's scales and in a correspondingly shaped opening in the blade, the block creating an interference between both of such openings, thereby preventing rotation. However, the geometry of the block need not necessarily be a rectangle. Another example would be a block shaped in an elliptical manner. Simple geometrical shapes would be easier and less costly to produce.

Further embodiments described herein depict a block that embodies a combination of such geometrical shapes to achieve the desired lock or fixing implementation. A demonstrable depiction of this combination is a square configuration in combination with a rectangular configuration, which advantageously facilitates manufacture. The further embodiments portrayed herein describe two such combinations implemented in two different ways to achieve different ends. These embodiments employ a pair of notches to form a stepped block and a single notch to form a stepped block respectively. The ends thereby achieved are locking mechanisms that accomplish a lock in two respective modes, one being two-position lock and the other a single position lock.

ADVANTAGES OF THE INVENTION

In reference to practical considerations for manufacture, no change in the tooling for the knife blade is required. Only a minor change in the tooling regarding the register opening of the scale is required. As to the existing lock block, a modification by additional machining steps to it only is required, whereby a block register opening combination can be produced from a three-position (see U.S. Pat. No. 4,750,267) lock block to a two-position or a one-position mechanism as disclosed herein.

An object of the invention is to provide novel lock and fixing mechanisms.

A further object of the invention is to provide novel knife locking mechanisms.

Another object of the invention is to provide ease of manufacture of knives.

A further object of the invention is to provide safe and legal knives.

A further object of this invention is to provide an economical advantage in making a series of geneologically derived knifes from one original knife by simply performing additional machining steps on some elements of the original knife.

Another object of the invention is to produce knives which meet or exceed the present socio-political trend away from knives that are capable of being opened one-handedly.

These and other objects and advantages of the invention will become more apparent upon a complete and full reading of the following description, the claims appended thereto, and the accompanying drawing comprising five (5) sheets of twenty-five (25) FIGURES.

BRIEF DESCRIPTION OF THE DRAWING

FIG. 12 is a diagrammatical sectional view of the knife of FIG. 11, assembled and in open locked position.

FIG. 13 is a view taken on line 13—13 of FIG. 12.

FIG. 14 is a view like FIG. 13 but with block depressed.

FIG. 15 is a diagrammatical sectional view of the knife of FIG. 12 but with blade and scale pivoted at right angles to one another.

FIG. 16 is a view taken on line 16—16 of FIG. 15.

FIG. 17 is a diagrammatical sectional view of the knife of FIG. 12 but with blade in closed locked position.

FIG. 18 is a perspective view of a block forming another embodiment of the invention.

FIG. 19 is a diagrammatical sectional view employing the block of FIG. 18, with blade in open locked position.

FIG. 20 is a view taken on line 20—20 of FIG. 19.

FIG. 21 is a view like FIG. 20 but with block depressed.

FIG. 22 is a diagrammatical sectional view of the knife of FIG. 19 but with blade and scale pivoted 90° to one another.

FIG. 23 is a view taken on line 23—23 of FIG. 22.

FIG. 24 is a diagrammatical sectional view of the knife of FIG. 19 but with blade in closed unlocked position.

FIG. 25 is a view taken on line 25—25 of FIG. 24.

BEST MODE (S) FOR CARRYING OUT THE INVENTION

Figures 1, 2, 3, 4:
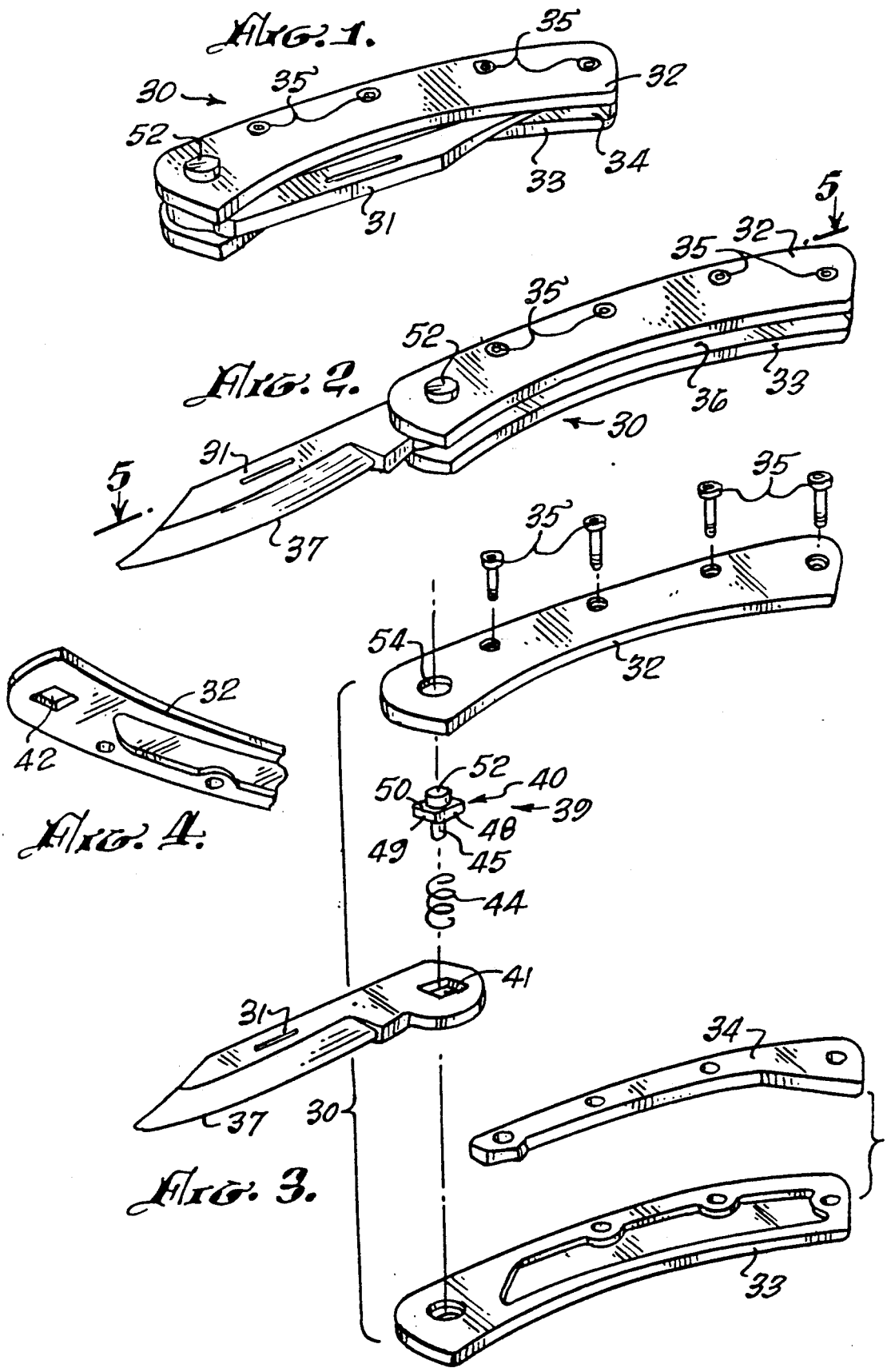
FIG. 1 is a perspective view of a knife in a locked and closed mode embodying our invention.
FIG. 2 is a perspective view of such knife in a locked and open mode.
FIG. 3 is an exploded perspective view of one embodiment of the knife of FIGS. 1 and 2.
FIG. 4 is a perspective underside fragmentary view of the scale illustrated at the top of FIG. 3.
Figure 5:
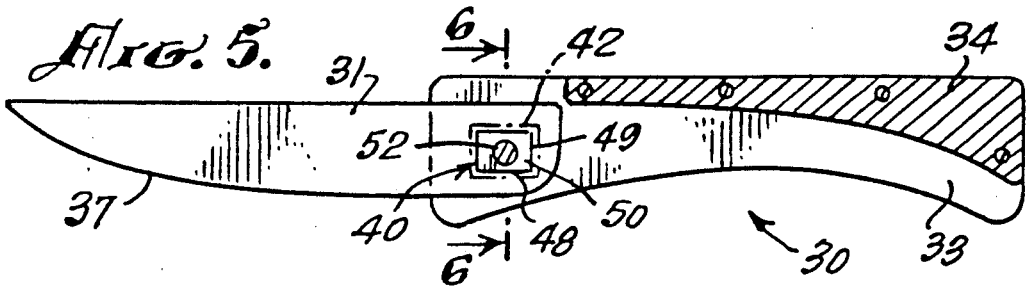
FIG. 5 is a diagrammatical sectional view of the knife in open locked position, taken on line 5—5 of FIG. 2.

Referring now to the drawing wherein reference characters correspond to like numerals hereinafter, the present invention is embodied in one way in a foldable knife 20, FIGS. 1–10. Knife 30 comprises a blade 31 pivotally mounted to a pair of scales 32, 33 spaced from one another by a spacer 34, FIG. 3, and which assembly also can be generally described as a clevis. A plurality of Allen-head screws 35 secure together scales 32, 33 and spacer 34 by means of suitable tapped holes while forming a pocket 36, FIG. 2, between scales 32, 33 for disposition of blade 31 in the knife's closed mode, this securement and spacing known in the art. Blade 31 pivots about scales 32, 33 from the closed mode to its open mode in which the blade and its cutting edge 37 are exposed, and vice versa, this being true in all embodiments disclosed herein. The tang end of blade 31 with its rectangularly-shaped opening form a "tongue" or "rod end" of the clevis.

In particular, FIGS. 3–10, a mechanism 39 comprising a non-arcuate polyhedral or rectangularly-shaped block 40 and rectangularly-shaped openings 41, 42 in blade 31 and the one scale 32, respectively, provide the means to lock blade 31 in either of two (2) positions, open mode or closed mode. The manner of urging block 40 to either of such positions, is illustrated in the FIGURES by a coiled spring 44 mounted about a post 45 mounted to block 40 and which post projects into or through a suitable hole in the other scale 33 of the knife's handle. Such urging is not part of this invention. The disclosure of such urging will be found in U.S. Pat. No. 4,750,267, granted June 14, 1988, and is incorporated herein by reference to this embodiment and to all the other embodiments disclosed herein.

Block 40 comprises spaced longer edges 48 joined together by spaced narrower edges 49 (and vice versa), and spaced faces 50 which determine the thickness of the block. A button 52 is mounted to block 40, extending from the one face in a direction opposite to that of post 45 which extends from the other face, the axes of post and button being coincident and forming an axle that is pivotable. Button 52 extends into and through a suitable hole 54 in scale 32. Opening 42 in scale 32 is formed by walls 56 which substantially correspond in their respective lengths to their facing edges 48, 49 of block 40, thus, providing a shape which prevents rotation in it of block 40 when the latter is disposed in it. This shape constitutes a register which is a basis for origin or termination of movement of the geometrical element or block 40 in its function during operation of the invention.

Blade 31 includes opening 41 formed by walls 57 which substantially correspond in their respective lengths to their facing edges 48, 49 of block 40.

Figure 6:
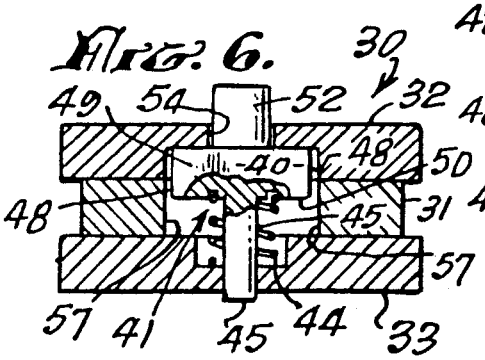
FIG. 6 is a view taken on line 6—6 of FIG. 5.
Figure 10:
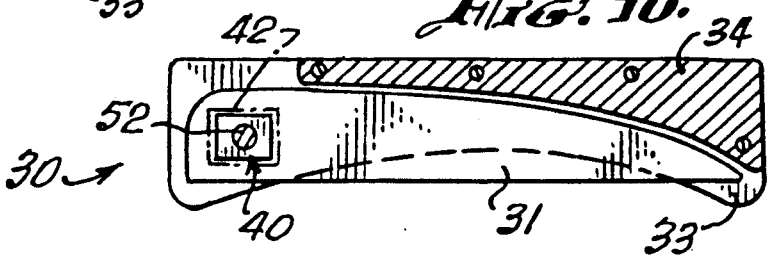
FIG. 10 is a diagrammatical sectional view of the knife of FIG. 5 but with blade in closed locked position.
Figure 11:
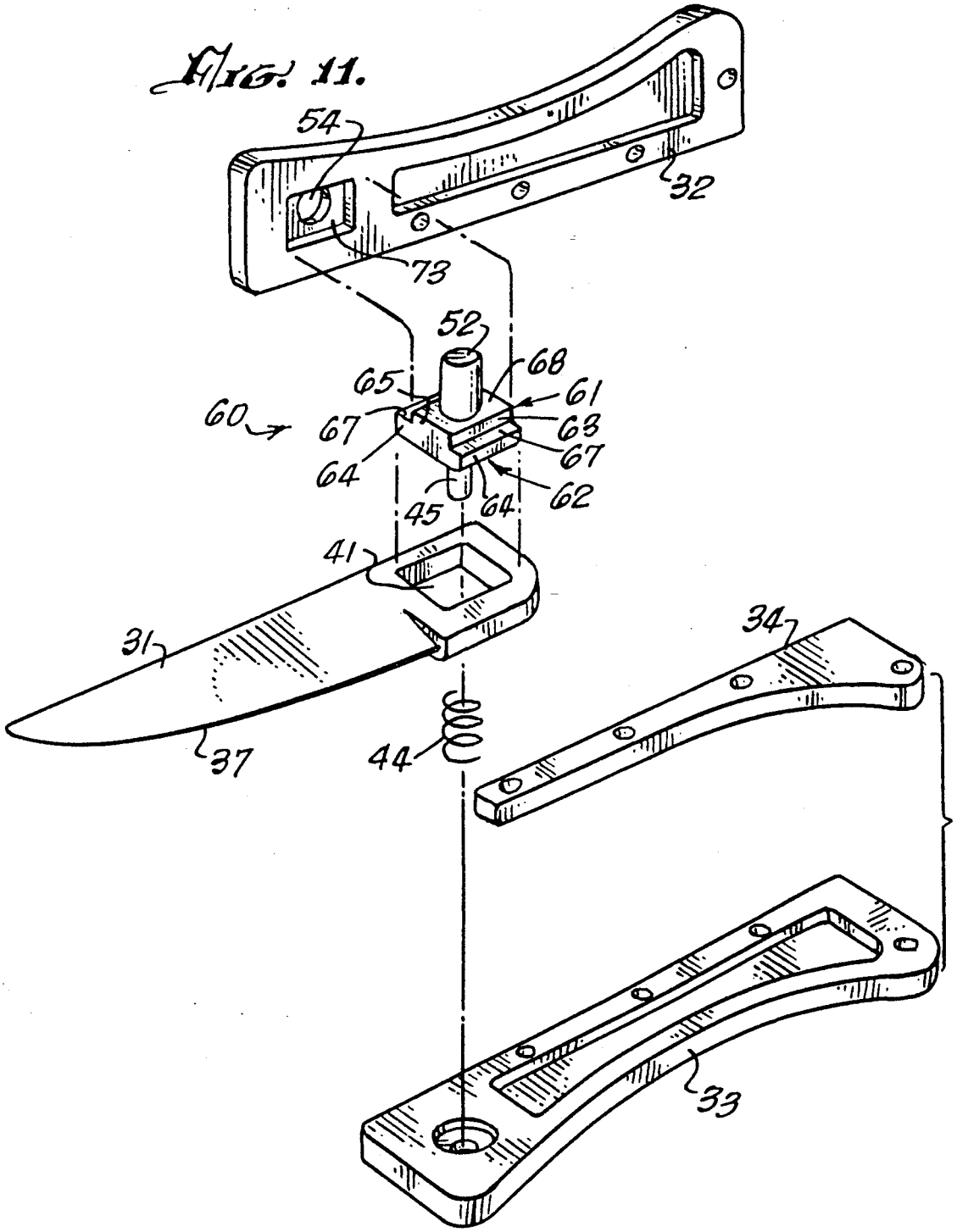
FIG. 11 is an exploded perspective view of another embodiment of the invention.

FIGS. 6 and 10 illustrate block 40 in its two (2) locked positions, open and closed modes, respectively, and which registers to the shape of opening 42 formed by walls 56 of scale 32. The longer edges 48 of block 40, the longer of walls 56 forming scale opening 42, and the longer of walls 57 of blade opening 41, are oriented in their respective elements so as to produce either mode, open or closed. Thus, it becomes apparent that the inventive concept comprehends a 90° change for the FIGURE orientations in the drawing for such longer edges 48, and the longer of walls 56, 57, however, for practical considerations such as strength in the knife itself, the FIGURES illustrate the best orientation for such elements and openings therein.

Figure 8:
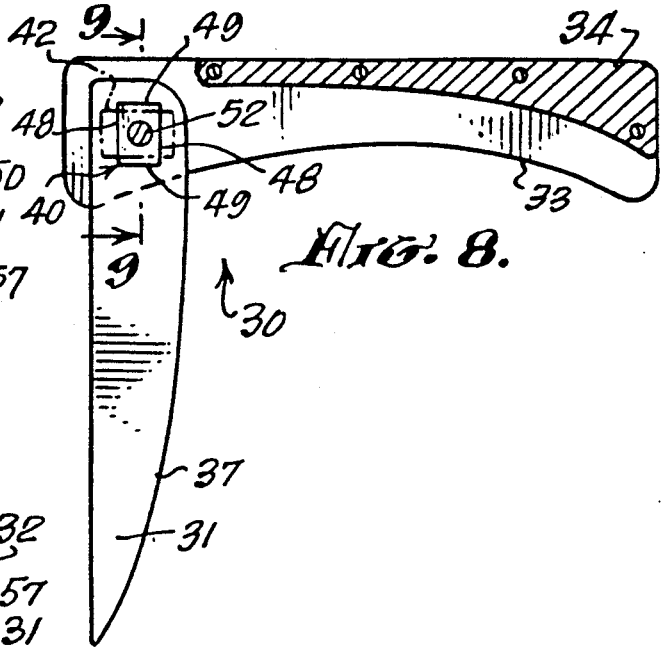
FIG. 8 is a diagrammatical sectional view of the knife of FIG. 5 but with blade and scale pivoted 90° to one another.
Figure 7:
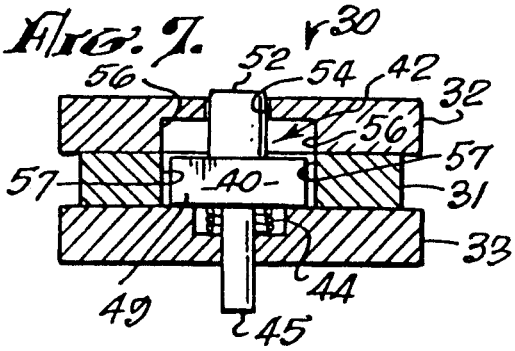
FIG. 7 is a view like FIG. 6 but with block depressed.
Figure 9:
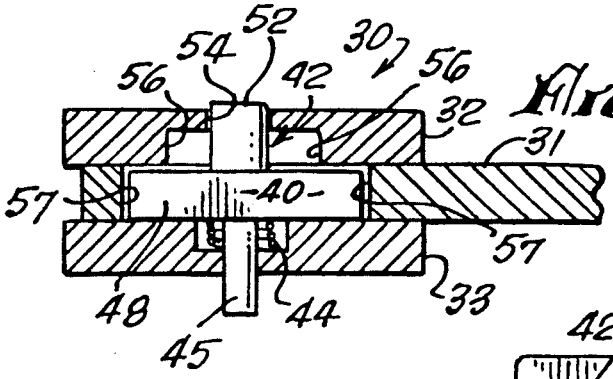
FIG. 9 is a view taken on line 9—9 of FIG. 8.

In operation, from either locked position illustrated in FIGS. 6 and 10, button 52 is depressed against the opposing urge provided by spring 44, thereby withdrawing block 40 from its register in opening 42 of scale 32 and disposing it in opening 41 within the thickness of blade 31, FIG. 7. The blade and scales (or handle) thus are free to rotate or pivot about each other until the alternate locked position is reached. FIG. 8 illustrates that no registry of block opening to scale opening occurs throughout the pivot or rotational movement for the knife. At the alternate locked position, block 40 rises by reason of the action of spring 44 to again register in opening 42 of scale 32, and lock the knife.

It should now be apparent that the orientation of the described openings in their corresponding elements need not be always paralled to or at a right angle to the longitudinal axis of knife 30. But it can be observed that such openings can be from such axis or line of reference utilized in the manufacture of the knife.

It should be further understood that the diameter of button 52 and the length of the narrower edges 49 of block 40 are preferably substantially the same, although the length of such edges 49 may be of shorter or greater lengths than the diameter of button 52.

Referring now to FIGS. 11–17, another embodiment 60 of the invention is illustrated. Embodiment 60 comprises in one sense a geometrical or non-arcuate polyhedral or rectangularly-shaped element or block 61 and a square-shaped block 62 mounted one to the other, and preferably integrally formed from and shaped in one member. In one sense, the longer opposing edges 63 of block 61 are of the same length as the square edges 64 of block 62, while the length of the narrower opposing edges 65 of block 61 are less than the lengths of edges 64 in square block 62. In another sense, opposing steps or notches 67 are formed, such as by milling, in a one piece square block whose thickness is the sum of the thicknesses of both blocks 61, 62. In either case, a block is utilized in this embodiment and comprises edges defined within a pair of opposing faces 68, 69, with a pair of notches 67 created out of face 68 and the opposing edges 64. Again the manner of urging the entire block or block mechanism in a direction towards button 52 which extends from face 68, by means of coiled spring 44 mounted about post 45 extending from face 69, is not part of this invention, and is disclosed in the noted U.S. Pat. No. 4,750,267, and by reference is incorporated into this disclosure.

The blade 31 includes a square-shaped opening 71 into which block 62 seats and is disposed. The scale 32 includes not an opening which corresponds to opening 71, but includes an opening 73 which forms a register for the geometrical or non-arcuate polyhedral shape of the element or block 61.

In operation, FIGS. 12 and 13 illustrate the blade in locked open position. Button 52 is depressed, FIG. 14. The geometrical or non-arcuate polyhedral shape 61 has been withdrawn from opening 73, while the entire block (including the square-shaped portion 62) lies within opening 71 of blade 31. Blade 31 now is free to rotate, pivoting about the axle formed by button 52 and post 45, FIG. 15 illustrating its freedom to rotate from its FIGS. 12, 13 opened locked position to a locked closed position in pocket 36 between scales 32, 33, FIGS. 13, 17. It should be noted that element 61 in such rotation cannot re-enter or rise into opening 73, FIG. 16, until it is again in a position at which its opposing edges 63 are in alignment with the walls forming opening 73 in scale 32, as is illustrated by FIG. 17. This is true, of course, also in the reverse action from the closed locked position of FIG. 17, through the action illustrated by FIGS. 16, 15, and then to the open locked position, FIG. 13 for knife 30.

Referring now to FIGS. 18–25, another embodiment of the invention is illustrated. The embodiment comprises, FIG. 18, an entire block or block mechanism 81 comprising but one notch or step 83 formed from or created out of one of two opposing faces 85, 86 which define the edges 87 in the geometrical or square-shaped element 81. Again, a rectangularly-shaped element or block 88 is formed by such single notch 83. The blade 31 retains the same geometrical shape as opening 71 which was included in the embodiment illustrated in FIGS. 11–17. However, scale 32 includes an opening 89 which forms a register for the geometrical shape of element or block 88, but which in addition is offset, FIGS. 19, 20, towards the center of rotation for blade 31. The opening 89 corresponds geometrically to the stepped block 88. Thus, when the latter is in a position capable of being locked, the urging means 44 mounted about post 45 raises the stepped block 88 into register with opening 89 in scale 32.

The operation of this embodiment now should be apparent. Blade 31 is in open locked position, FIGS. 19, 20, by reason of stepped block 88 being registered to opening 89 in scale 32. Button 52 is depressed, FIG. 21, thus withdrawing stepped block 88 from such opening 89 and into opening 71 in blade 31. Blade 31 now is free to rotate into a closed position. FIGS. 22, 23 illustrate the location of block 81 in reference to blade 31 and opening 89 in scale 32. The opening 89 in FIG. 22 is shown in phantom since scale 32 itself is not illustrated in that FIGURE. FIGS. 24, 25 illustrate blade 31 in a closed but unlocked position, by reason of the fact that stepped block 88 is not in registry with opening 89 of scale 32. The blade 31 remains in a condition to rotate back towards its open position at which it becomes locked by reason of stepped block 88 rising to register in opening 89 (again, FIG. 20).

In assembly knife 30, the button and block are inserted into the register opening of scale 32. Blade 31 is placed over the block. One or two screws 35 are put into their corresponding holes in scale 32, the spacer 34 is placed over the screws, the coiled spring is installed over post 45, scale 33 is set into place on the other side of spacer 34, and the screws 35 are tightened into tapped holes (not shown) in scale 33. The remaining screws then are applied. Adjustment between blade and spacer may be necessary, and if so, this is accomplished in known manner in the cutlery art.

In making the elements of the subject matter of the invention, each scale is formed from two blanks stamped out of metal, a total of four (4) blanks from which two outer and two inner panels are stamped, one outer and one inner panel forming each scale. Spot welding is used to bond each outer and inner panel securely together, to form a scale. The scale openings or holes described above are stamped out in the stamping of the blanks, their locations and dimensions being based on engineering specifications. The blade and its opening is formed in known manner out of stainless steel. Each of the blocks with button and post is formed from a suitable metal, in known manner, although the post and button alternately can be a separate piece splined and press fit to a socket or cavity formed in the block. The spring and screws are of known materials.

INDUSTRIAL APPLICABILITY

The locking mechanisms illustrated are not limited to a knife construction or other cutlery products. The mechanisms can be utilized to replace or supercede locking arrangements for joints, examples of which being found in ladders, leg braces or similar devices. Further, they can be utilized in any clevis-and-tongue configured joint.

We claim:

1. In a foldable knife having a blade with an opening therein, spaced scales one of which having an opening and between which scales the blade pivots, a block with opposing faces, the block when in said one's opening locking the blade to its scale, a register formed by said one's opening, and means for urging said block into said one's opening, the block depressible into the blade's opening by overcoming said urging means thereby providing rotation for the block about a pivot, the pivot and its axle being mounted to said scale and formed by a button and post attached to corresponding ones of the opposing faces of the block, the improvement comprising said block having a non-arcuate polyhedral shape that includes a longer dimension and a narrower dimension thereto, the register in said one's opening corresponding to the longer dimension of said block, said blade's opening including a dimension that corresponds to the longer dimension in said block.

2. In the improvement of claim 1, said non-arcuate polyhedral block and the register for said one's opening being of rectangular configuration.

3. In a foldable knife having a blade, spaced scales into and from which the blade pivots, a block having opposing faces that define edges, said block locking the blade in position relative to the scales, means for urging said block into such a locked position, the block depressible against said urging means, an axial formed by a button and a post disposed on said opposing faces, the improvement comprising a pair of notches in said block created from one of said opposing faces and two of said edges, a register in said one of said scales formed by an opening therein and which corresponds geometrically to said one of said faces created by said pair of notches in said block, said blade including an opening that corresponds to the shape of the other of said opposing faces.

4. In the improvement of claim 3, said block having said other of said opposing faces square-shaped, said one of said opposing faces being of a rectangular shape.

5. In a foldable knife having a blade, spaced scales forming a pocket into and from which the blade pivots, a block having opposing faces that define edges, said block locking the blade in position relative to the scales, means for urging the block into such a locked position, the block depressible in the knife by overcoming the urging means, thereby providing rotation about a pivot, the pivot being an axle formed by a button and post disposed on opposing faces of the block, the improvement comprising a notch created from one of said faces and the adjacent one of said edges of said block thereby generating a stepped block, one of said scales including an opening forming a register that corresponds geometrically to the one of said faces created by said notch in said block, said blade including an opening that corresponds geometrically to the shape of the other of said opposing faces, said stepped block not being in alignment with the opening in the scale when the blade is in the pocket, said stepped block registerable in the opening of said one of said scales thereby locking the blade in its open position.

6. In the improvement of claim 5, said block having said other of said opposing faces square-shaped, said one of said opposing faces being of a rectangular shape.

7. In a locking mechanism whereby the motion or action of a joint is specifically restricted by such mechanism in operation of the device to which the mechanism is operatively connected, the mechanism including a clevis formed by a yoke, pivotable tongue, and a pin joining yoke and tongue together, said yoke including a non-arcuate polyhedral opening forming a register, said tongue including a non-arcuate polyhedral opening cooperatively related to said register, said pin including a non-arcuate polyhedral block disposed within said openings to create an interference between said yoke and tongue that prevents rotation, and thereby creates a fixed or locked condition, the improvement comprising said pin having opposing spaced faces defining edges, a pair of notches created from one of said faces and two of said edges, the yoke's opening's register corresponding to a corresponding one of said faces created by said pair of notches in said block, the tongue's opening corresponding to the shape of the other of said opposing faces.

8. In the improvement of claim 7, said pin being of rectangular configuration.

9. In the improvement of claim 7, said pin being square-shaped and in combination with a rectangular configuration therein.

10. In the improvement of claim 7, said pin being longer than it is narrower.

11. In a locking mechanism whereby the motion or action of a joint is specifically restricted by such mechanism in operation of the device to which the mechanism is operatively connected, the mechanism including a clevis formed by a yoke, pivotable tongue, and a pin joining yoke and tongue together, said yoke including a non-arcuate polyhedral opening forming a register, said tongue including a non-arcuate polyhedral opening cooperatively related to said register, said pin including a non-arcuate polyhedral block disposed within said openings to create an interference between said yoke and tongue that prevents rotation, and thereby creates a fixed or locked condition, the improvement comprising said pin having edges defined within opposing faces, a notch created from one of said faces and the adjacent one of said edges of the tongue thereby generating a stepped block, the yoke's register corresponding to the one of said faces created by said notch in the block, the tongue's opening corresponding to the shape of the other of said opposing faces, said stepped pin not being in alignment with the yoke's opening when the tongue is in a first position, said stepped block registered in the yoke's opening thereby locking the tongue in a second position.

12. In the improvement of claim 11, said pin being of rectangular configuration.

13. In the improvement of claim 11, said pin being square-shaped and in combination with a rectangular configuration therein.

14. In the improvement of claim 11, said pin being longer than it is narrower.

* * * * *